US006373364B1

(12) United States Patent
Son et al.

(10) Patent No.: US 6,373,364 B1
(45) Date of Patent: Apr. 16, 2002

(54) ELECTROMAGNET FOR THIN-FILM PROCESSING WITH WINDING PATTERN FOR REDUCING SKEW

(75) Inventors: Jeong W. Son, Gainesville; David A. Baldwin, Annandale, both of VA (US)

(73) Assignee: CVC Products, Inc., Rochester, NY (US)

( * ) Notice: Subject to any disclaimer, the term of this patent is extended or adjusted under 35 U.S.C. 154(b) by 93 days.

(21) Appl. No.: 09/614,045

(22) Filed: Jul. 11, 2000

Related U.S. Application Data

(60) Provisional application No. 60/179,914, filed on Feb. 3, 2000.

(51) Int. Cl.[7] ..... C14C 14/35; H01F 5/00

(52) U.S. Cl. ..... 335/296; 335/299; 204/298.16

(58) Field of Search ..... 335/296–299; 204/298.16–298.22, 298.37

(56) References Cited

U.S. PATENT DOCUMENTS

| | | | | |
|---|---|---|---|---|
| 4,155,825 | A | 5/1979 | Fournier | 204/192 R |
| 4,673,482 | A | 6/1987 | Setoyama et al. | 204/298 |
| 4,865,709 | A | 9/1989 | Nakagawa et al. | 204/192.12 |
| 5,026,470 | A | 6/1991 | Bonyhard et al. | 204/298.16 |
| 5,630,916 | A | 5/1997 | Gerrish et al. | 204/192.2 |
| 5,902,466 | A | 5/1999 | Gerrish et al. | 204/298.16 |
| 6,042,707 | A | 3/2000 | Moslehi et al. | 204/298.16 |
| 6,249,200 | B1 * | 6/2001 | Stelter et al. | 335/299 |
| 6,290,824 | B1 * | 9/2001 | Ishikawa et al. | 118/719 |

FOREIGN PATENT DOCUMENTS

| | | |
|---|---|---|
| JP | 3087-365 A | 4/1991 |

* cited by examiner

*Primary Examiner*—Ramon M. Barrera
(74) *Attorney, Agent, or Firm*—Eugene Stephens & Associates; Thomas B. Ryan

(57) ABSTRACT

An electromagnet that produces a uniaxial magnetic field for magnetically orienting thin films on a substrate in a low-pressure processing environment is arranged with a plate-shaped core having a circular periphery and an electromagnetic coil having windings that are arranged in a pattern across a front side of the core for reducing skew of the uniaxial magnetic field. The individual windings include lengths divided in different proportions between straight center sections and two bent end sections. The straight sections of the windings, which extend normal to a winding axis, incrementally decrease in length from the center towards the periphery of the core along the winding axis. Spacing between adjacent center sections of the windings is greater than a spacing between adjacent end sections of the front winding portions along the core periphery. The end sections are increasingly bent at the core periphery as a function of cumulative differences in spacing between the center and end sections.

29 Claims, 5 Drawing Sheets

ELECTROMAGNET FOR THIN-FILM PROCESSING WITH WINDING PATTERN FOR REDUCING SKEW

This application claims the benefit of U.S. Provisional Application No. 60/179,914, filed on Feb. 3, 2000, which provisional application is incorporated by reference herein.

TECHNICAL FIELD

Thin magnetic films deposited (e.g., by physical-vapor deposition processes such as plasma sputtering and ion-beam deposition methods) onto substrates in low-pressure processing environments can be magnetically oriented to a single axis, a condition referred to as "uniaxial anisotropy", by exposing the films to orienting magnetic fields with sufficient field strength that exhibit high magnetic flux uniformity and little angular skew during the deposition or subsequent post-deposition processing of the films (such as magnetic annealing processes). Magnetic orientation of thin films can take place in conjunction with various applications including thin film deposition and thermal anneal processes as well as thin-film magnetic metrology.

BACKGROUND

Thin-film magnetic recording heads are usually fabricated using a combination of material layers including one or more layers of thin soft and hard magnetic films, some of which may have magnetic domains oriented along one or multiple magnetic axes. Generally, the magnetic films are deposited onto substrates in low-pressure processing chambers by physical-vapor deposition (PVD) methods such as plasma sputtering or ion-beam deposition processes. The magnetic domains of these films are oriented by exposing the films to in-plane magnetic fields either during their deposition or during a subsequent processing step such as magnetic annealing. The magnetic fields have specific requirements specifying the upper limits for both "skew" (deviation in direction) and "non-uniformity" (deviation in magnitude). Typical in-plane magnetic field strengths are in the range of 50 to 100 Oersted.

Either permanent magnets or electromagnets can be used for generating the substantially uniaxial magnetic fields. For example, Nakagawa et al. in U.S. Pat. No. 4,865,709 mount thin magnetic film substrates between pairs of permanent magnets on a substrate holder. Opposite poles of the magnets face each other for generating approximately uniaxial magnetic fields across the thin film surfaces of the substrates. However, the permanent magnets are difficult to position, have limited magnetic field strength and adjustability, and are exposed to processing that can affect their long-term performance (resulting, for instance, in long-term field drift). Permanent magnets may also have detrimental effects on the PVD plasma uniformity and repeatability. Moreover, permanent magnets provide no or limited capability for field magnitude or orientation adjustments.

Setoyama et al. in U.S. Pat. No. 4,673,482 position a pair of magnetic field-generating coils on opposite sides of a substrate outside a low-pressure processing chamber in which the substrate is mounted. The coils are located at a considerable distance from the substrate and only a small portion of the resulting magnetic field exhibits the required uniaxial characteristics. Magnetic field adjustability is also limited. Moreover, this type of magnetic field source can produce significant plasma non-uniformity and magnetic interference problems associated with magnetron PVD energy sources.

Co-assigned U.S. Pat. No. 5,630,916 to Gerrish et al. overcomes many of these problems by positioning a plate-shaped electromagnet adjacent to the substrate positioned over a substrate support. The plate-shaped electromagnet is isolated from the processing environment by the substrate support (i.e., electromagnet located outside the vacuum processing chamber) but is still close to the substrate. The substantially planar plate-shape of the electromagnet, which parallels the substrate, produces a uniaxial field of high uniformity and relatively low skew in the immediate vicinity of the substrate surface. An angularly adjustable support provides for mechanically orienting the plate-shaped electromagnet with respect to the substrate support for fine tuning the magnetic orientation axis.

More recently, tolerances for magnetic field skew (angular deviation from the preferred orientation axis) and non-uniformity have become increasingly stringent and the size of the substrates has become increasingly large. Both trends pose similar problems for the available magnetic field orienting equipment. Larger electromagnets can be used to some extent. However, various practical considerations limit the size of the electromagnets. For example, Gerrish et al.'s electromagnet is required to fit within a substrate holder, which is itself limited in size by surrounding vacuum processing chamber dimensions. Unused portions of the magnetic fields produced by the larger magnets beyond the substrate surface area can interfere with substrate processing such as by altering the path of ions to the substrate (thus causing plasma process uniformity degradation) or imbalancing target erosion (e.g., via magnetic field interference with the PVD magnetron energy source).

SUMMARY OF THE INVENTION

A reduction in the skew of uniaxial magnetic fields used for orienting thin magnetic films has been achieved by arranging an electromagnet with a specially shaped core and with windings that depart from a common orientation. Preferably, the core of our new electromagnet takes the form of a plate having a peripheral shape that departs from a rectangle in the direction of a circle to contribute to the reduction in skew while economizing space within a chuck housing. The windings are preferably individually spaced and progressively bent to form a pattern that improves uniaxial alignments of the magnetic field and increases the useful area of the magnetic field for orienting thin magnetic films on larger substrates.

Our new electromagnet is preferably mounted in a chuck assembly that supports a substrate for processing in a low-pressure environment. The substrate is supported on a mounting surface of a chuck housing. The electromagnet is supported within an interior space of the chuck housing and produces a substantially uniaxial magnetic field in a plane of the substrate's surface. The magnetic field provides for magnetically orienting thin films on the substrate's surface during operations such as plasma sputtering, ion-beam deposition, and thermal annealing.

A magnetically permeable core of the new electromagnet is preferably plate-shaped and has a center, a periphery, and front and back sides wrapped by electrically conductive windings. The core periphery departs from a rectangular shape to achieve performance requirements while more completely filling the interior space of the chuck housing. Front portions of the electrically conductive windings extend across the front side of the plate-shaped core between the front side of the core and the mounting surface of the chuck housing. Back portions of the electrically conductive windings extend across the back side of the plate-shaped core in positions separated from the mounting surface by the core. The front winding portions individually depart from a linear form by differing amounts to reduce skew of the uniaxial magnetic field throughout the plane of the substrate's surface.

First and second orthogonal axes extend parallel to the front side of the plate-shaped core intersecting at the center of the core. The electromagnetic windings are wrapped around the first orthogonal axis and extend across the front side of the plate-shaped core in a pattern such that (a) the front portions of the windings close to the center of the core extend substantially parallel to the second orthogonal axis and (b) the front portions of the windings spaced from the center of the core are increasingly bowed with respect to the second orthogonal axis for reducing skew of the uniaxial magnetic field along the surface of the substrate.

The bowed winding portions preferably have generally concave shapes facing the center of the core in a pattern that is symmetric with respect to both the first orthogonal axis and the second orthogonal axis. A center section of the individual bowed winding portions extends parallel to the second orthogonal axis and two end sections of the individual bowed winding portions are bent with respect to the second orthogonal axis. The center sections are spaced apart, such as by shims, and the two end sections are spaced more tightly together along the core periphery. The spacing differences between the center and end sections incrementally increases bending at the core periphery as a function distance in either direction along the first orthogonal axis from the core center. Incremental length variations between adjacent center sections of the windings support smooth transitions between the straight center sections and the bent end sections of the windings.

The non-rectangular periphery of the plate-shaped core preferably departs from a rectangular shape in the direction of a circle. The most preferred shape of the core periphery is a circle, which contributes to a reduction in skew and more completely fills the available interior space within the chuck housing.

DRAWINGS

DETAILED DESCRIPTION

Our invention is particularly suited to the manufacture of magnetic recording heads, "spin valves", and the like by magnetically orienting layers of magnetic film along one or more axes. Processing is typically accomplished at low pressures either during or after deposition of the magnetic film layers. For example, the orientations can be made during physical vapor deposition (PVD) operations or during subsequent thermal annealing operations.

Figure 1:
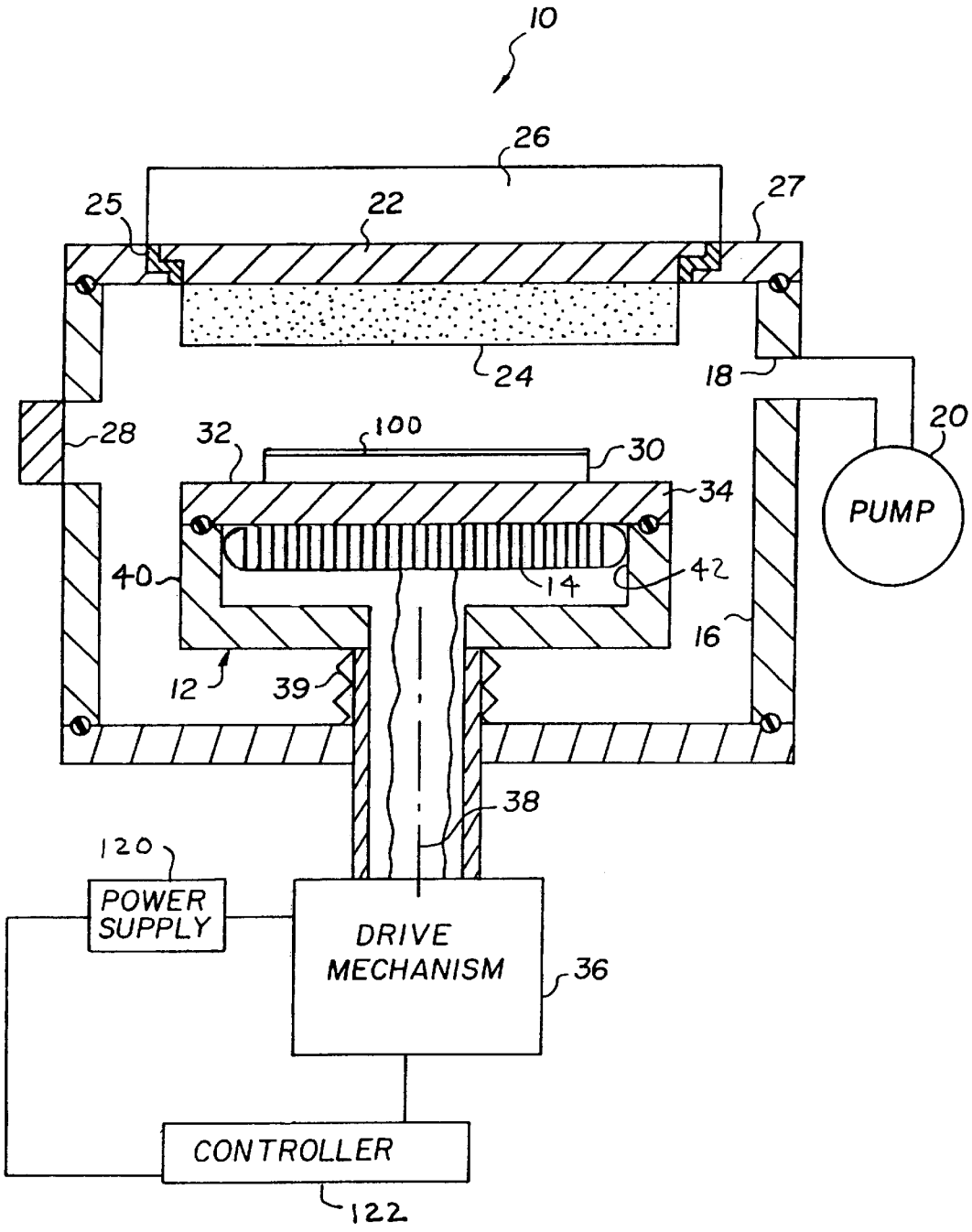
FIG. 1 is a cross-sectional schematic view of a sputtering apparatus having an improved electromagnet mounted within a chuck assembly for magnetically orienting a thin film on a surface of a substrate.

A conventional thin-film sputtering apparatus 10 is depicted largely schematically in FIG. 1 with a chuck assembly 12 arranged for supporting our new electromagnet 14. Conventional features include a low-pressure processing chamber 16 having an outlet port 18 connected to a vacuum pump 20 for evacuating air and plasma process gases from the chamber 16.

Opposite to the chuck assembly 12 is an electrode or backing plate 22 supporting a target 24 of a soft or hard magnetic material, such as ferromagnetic alloys including NiFe, FeTaN, FeAlN, FeCrHfN, NeFeRe, Sendust, or Copt. A magnetron 26 provides electrical energy and regulates erosion of the target 24 during sputtering operations. The magnetron 26 can be a DC magnetron or RF magnetron PVD energy source. Moreover, a non-magnetron energy source, such as RD diode, can also be used. The backing plate 22 receives the electrical power for target sputtering and is electrically isolated from a vacuum lid 27 using an insulating ring 25. An access valve 28 provides a resealable opening for moving a substrate 30 into and out of the chamber 16 (e.g., using a cluster tool central water handler).

The substrate 30 is supported on a mounting surface 32 of the chuck assembly 12. The mounting surface 32 is part of a mounting table 34 of a chuck housing 40, which can be arranged to regulate substrate temperature. For example, the table 34 can incorporate a heating unit, a cooling unit, or both. Heat exchanges between the table 34 and the substrate 30 can be facilitated by a heat-transfer gas. More detailed examples of chuck assemblies for regulating substrate temperature are found in commonly assigned U.S. patent application Ser. No. 08/938,293, filed Sep. 26, 1997, entitled "Two-Stage Sealing System for Thermally Conductive Chuck", and U.S. patent application Ser. No. 08/975,626, filed Nov. 21, 1997, entitled "Thermally Conductive Chuck for Vacuum Processor", which are both hereby incorporated by reference. The chuck assembly 12 can also be arranged to provide a capability for electrical biasing such as RF biasing of the substrate.

A drive mechanism 36 provides for translating the chuck assembly 12 along an axis 38 toward or away from the target 24 in order to control the substrate-to-target spacing. Bellows 39 seal the chuck housing 40 to the processing chamber 16 to accommodate a range of chuck assembly translation heights and to isolate the atmospheric components of the chuck assembly 12, including the electromagnet 14, from the evacuated space of the processing chamber 16 Sputtering and annealing operations for laying down and treating thin-film magnetic materials on substrates are well known.

Figure 2:
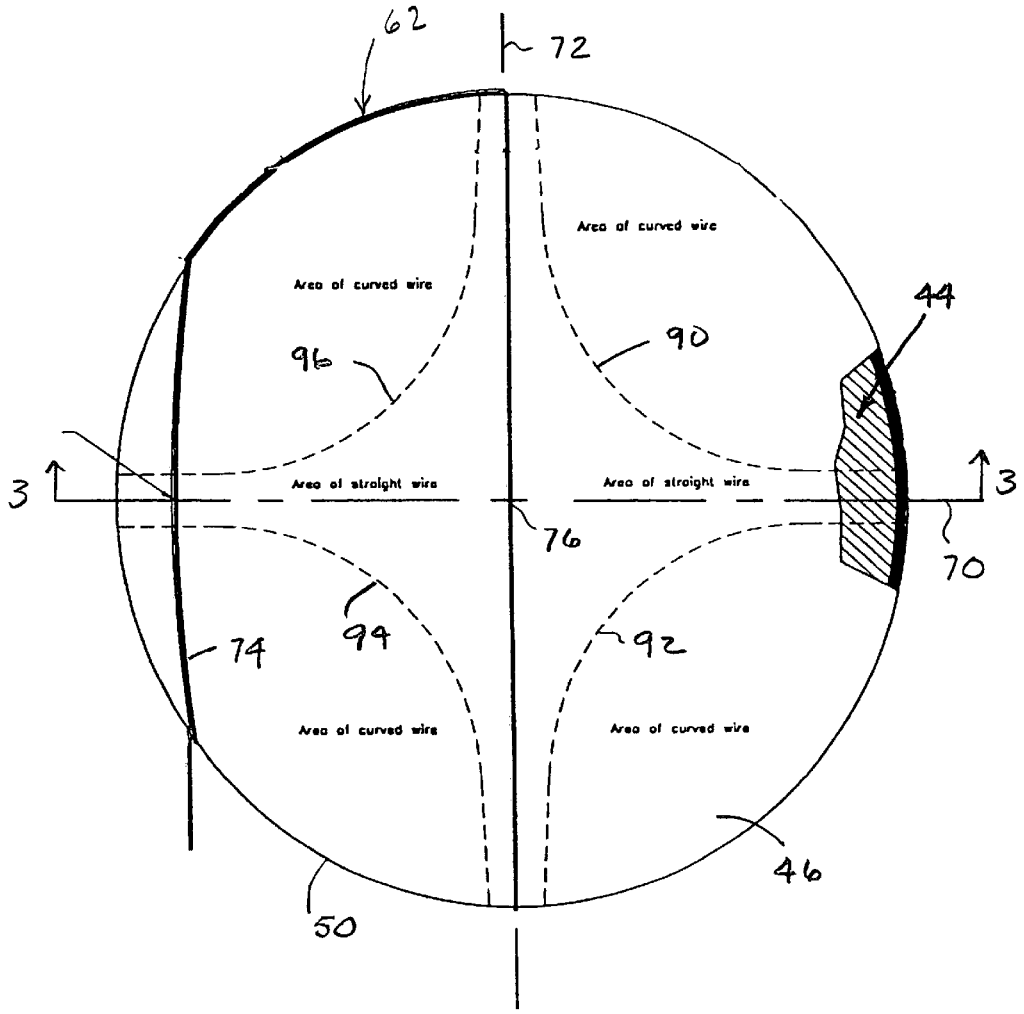
FIG. 2 is a plan schematic view of the electromagnet distinguishing between areas through which winding portions are straight or bent.
Figure 3:
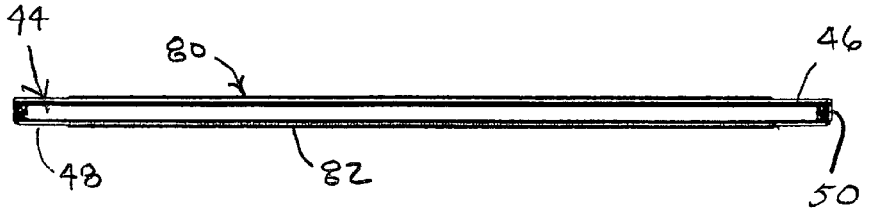
FIG. 3 is an end view of the electromagnet taken along line 3—3 of FIG. 2.
Figure 4:
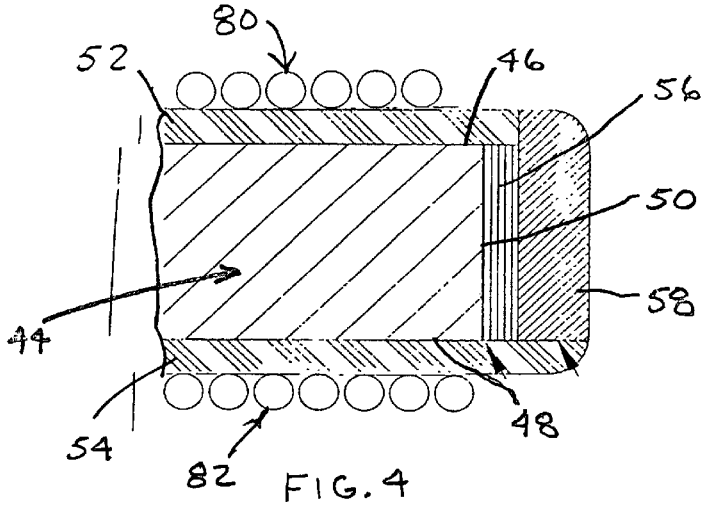
FIG. 4 is an enlarged view of a broken-away portion of the electromagnet appearing in FIG. 3.

Our new electromagnet 14 is supported within an interior space 42 of the chuck housing 40, which is generally circular in a plan view. More detailed views of the new electromagnet are shown in FIGS. 2–4. A plate-shaped core 44 of the electromagnet 14 is made of a magnetically permeable material and has a front side 46 and a back side 48 joined by a periphery 50 that has a generally circular shape. The core 44 can be made from steel, such as 1018 steel, but is preferably made from a magnetically softer material such as electrical iron, American Mu Metal, or HyMu "80", a nickel-molybdenum-iron alloy from Carpenter Technology Corp. Of these HyMu "80" is preferred on the basis of performance and cost.

Covering the front and back sides 46 and 48 of the core 44 are thin (e.g., approximately 1 millimeter) winding support layers of 52 and 54, which are preferably made of medium density balsa wood. The periphery 50 is wrapped with two winding support layers 56 and 58, which are also preferably made of medium density balsa wood. A cyanoacrylate adhesive is preferably used to bond the support layers 52, 56, 56, and 58 to the core 44.

Figure 5:
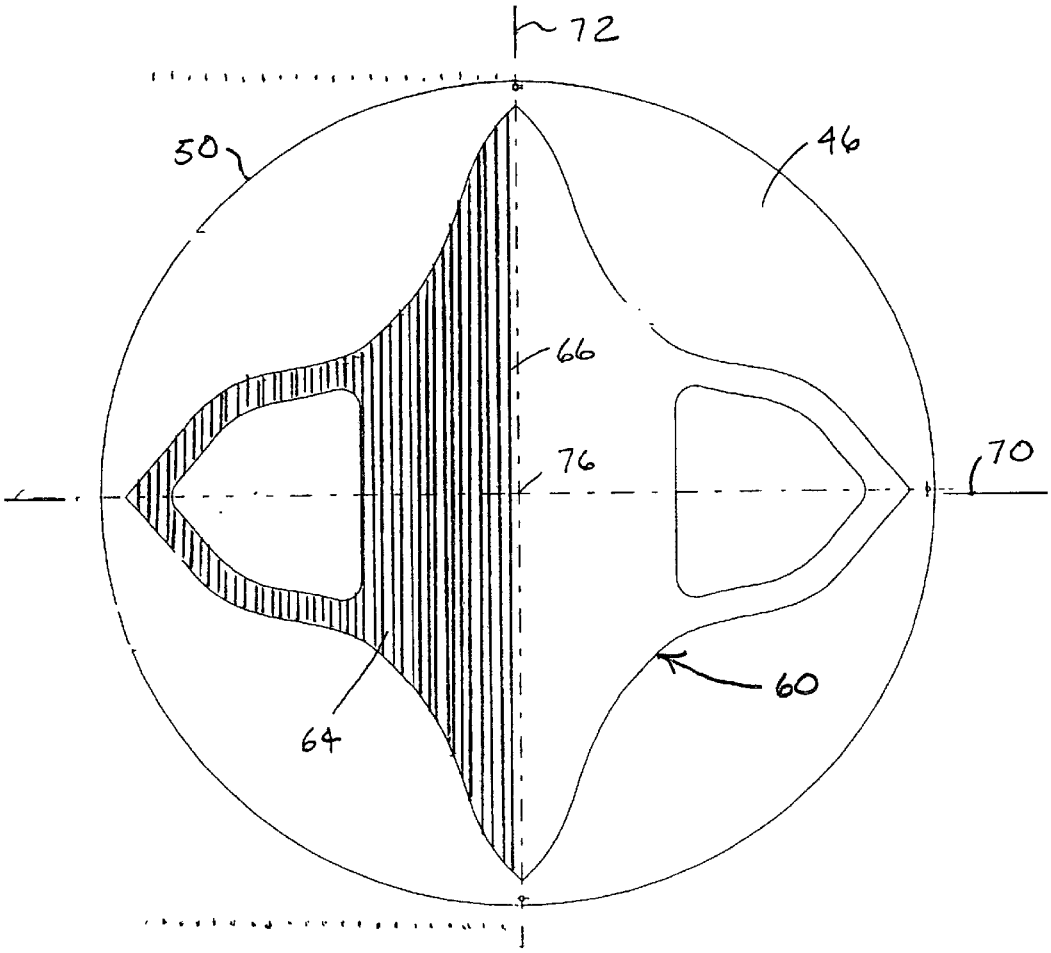
FIG. 5 is a plan view of a winding guide useful for arranging the winding portions in a pattern.

A winding guide 60, which can be printed on the support layer 52 or can be formed as a separate or replacement layer for the support layer 52, includes a pattern for wrapping an electromagnetic coil 62 around the core 44. In FIG. 5, an alternative winding guide 60*a* formed, for example, in a grooved plate made of a dimensionally stable machinable plastic has a series of straight line grooves 64*a* that are separated by shims 66*a* and have incrementally varying lengths.

Figure 6:
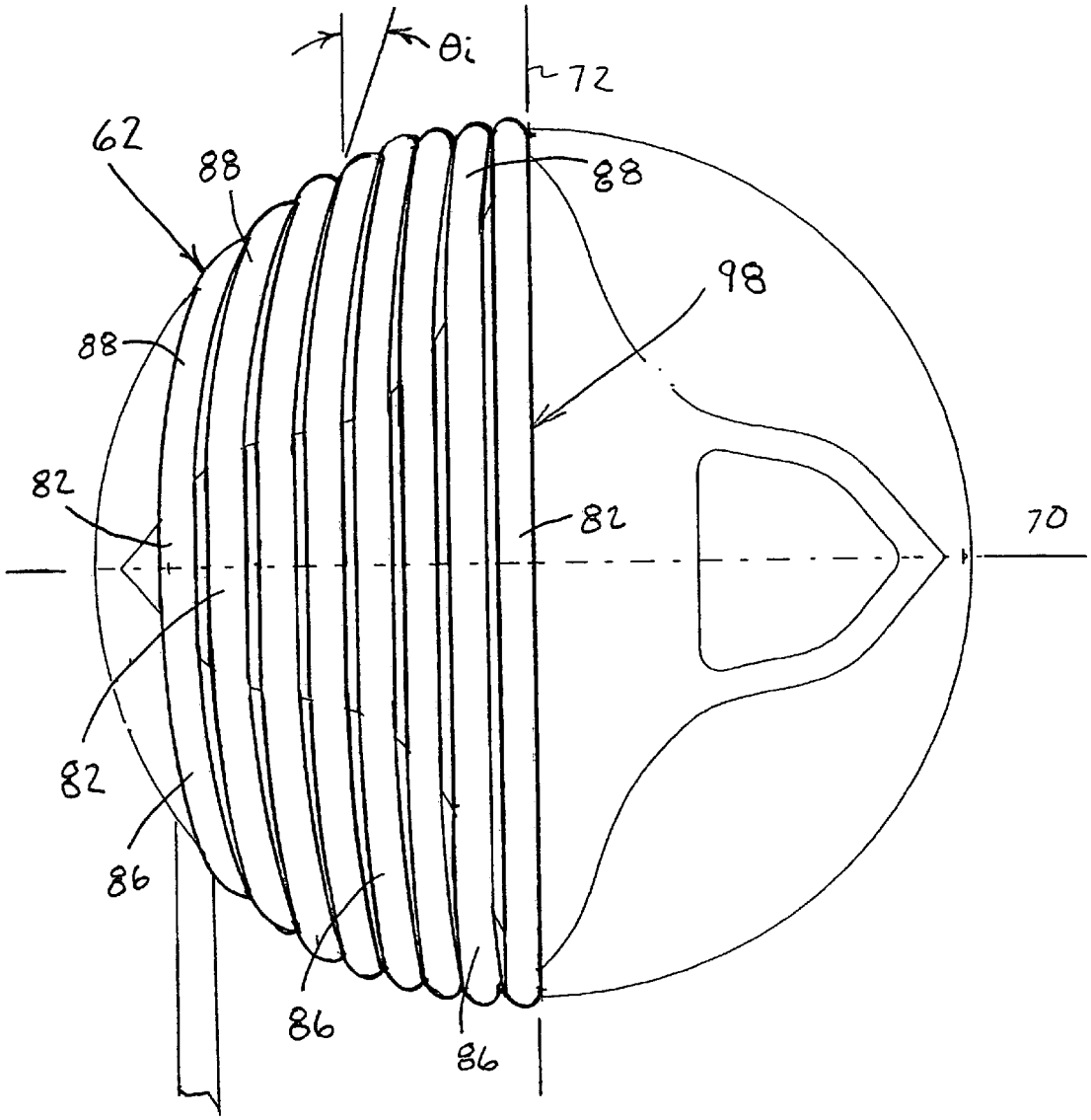
FIG. 6 is a plan view depicting a preferred winding pattern across one-half of a front side of the electromagnet with windings greatly enlarged to better show straight and bent sections of the windings.

Orthogonal axes 70 and 72 are depicted in the plan views of FIGS. 2, 5, and 6. The axis 70 corresponds to a direction around which the electromagnetic coil 62 is wound (i.e., a winding axis), and the axis 72 corresponds to a direction individual windings 74 of the electromagnetic coil 62 are laid out along the straight winding grooves 64*a* on winding guide 60*a*. The two orthogonal axis 70 and 72 intersect at a center 76 of the core 44.

The windings 74 encircle the core 44 about the winding axis 70 and are glued in place to the support layers 52 and 54 (e.g., using a cyanoacrylate adhesive). Front portions 80 of the windings 74 cross the front side 46 of the core 44 subject to the winding guide 60, and back portions 82 of the windings 74 cross the back side 48 of the core 44 without similar interruption. The front portions 80 of the windings 74 are generally divided into straight center sections 84 and two bent end sections 86 and 88. Following the guide 60, the straight center sections 84 are spaced apart along the winding axis 70, but the bent end sections 86 and 88 of adjacent winding portions 86 are wrapped tightly together along the periphery 50. The spacing differences between the center and end sections 84 and 86, 88 of the front winding portions 80 incrementally increase bending of the end sections 86 and 88 at the core periphery 50. Angles $\theta_i$ between the end sections 86 and 88 and the second orthogonal axis 72 along the core periphery 50 incrementally increase as a function of the distance along the winding axis 70 in either direction from the core center 76.

According to FIG. 2, the straight winding sections 84 occupy an area of the front side 46 of the core 44 bounded by substantially asymptotic curves 90, 92, 94, and 96 in each of four quadrants defined by the two orthogonal axes 70 and 72. Lengths of the straight winding sections 84 are greatest in the vicinity of the axis 72 and decrease incrementally approaching the core periphery 50 along the winding axis 70. The incremental decrease in the lengths of the straight winding sections 84 in either direction along the winding axis 70 supports smooth transitions between the straight winding sections 84 and the two bent winding sections 86 and 88, especially as the bending becomes more pronounced. The back portions of the windings 82 are wrapped straight across the back side 48 of the core.

As seen in FIG. 6, the straight and bent winding portions 84 and 86, 88 form a unique winding pattern 98 across the front side 46 of the core, which is symmetric with respect to both orthogonal axes 70 and 72. The pattern 98 includes winding portions 80 close to the center 76 of the plate-shaped core 44 extending substantially parallel to the second orthogonal axis 72 and other of the winding portions 80 spaced from the center 76 of the plate-shaped core 44 along the first orthogonal axis 70 bowed with respect to the second orthogonal axis 72. The winding portions 80 spaced from the center 76 of the plate-shaped core 44 are bowed in concave shapes facing the center 76 of the core 44. Together with the plate-shaped core 44 having a generally circular periphery 50, the winding pattern 98 improves directional uniformity (i.e., reduces skew) of a uniaxial magnetic field produced in a plane located on a surface 100 of the substrate 30.

Figure 7A:
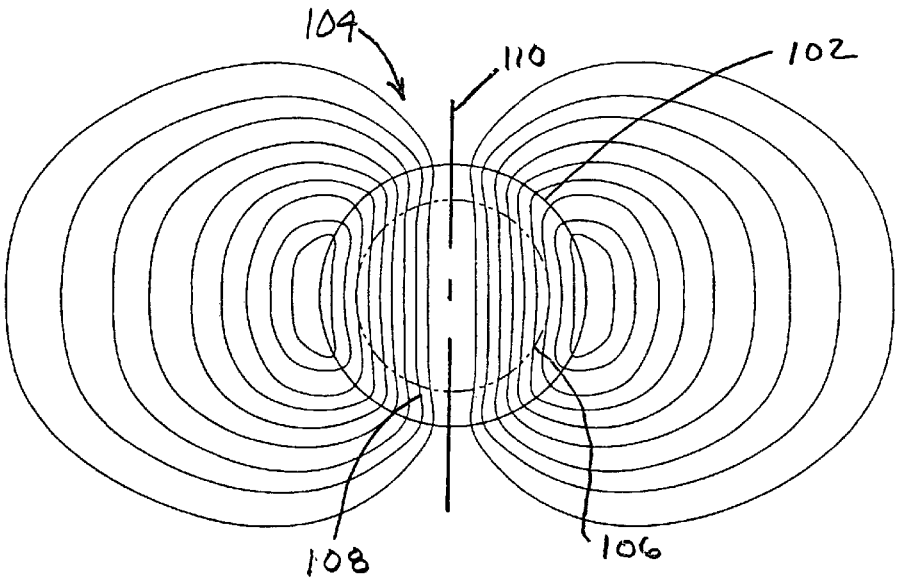
FIG. 7A is a diagram of a magnetic field produced with a conventional straight winding pattern.
Figure 7B:
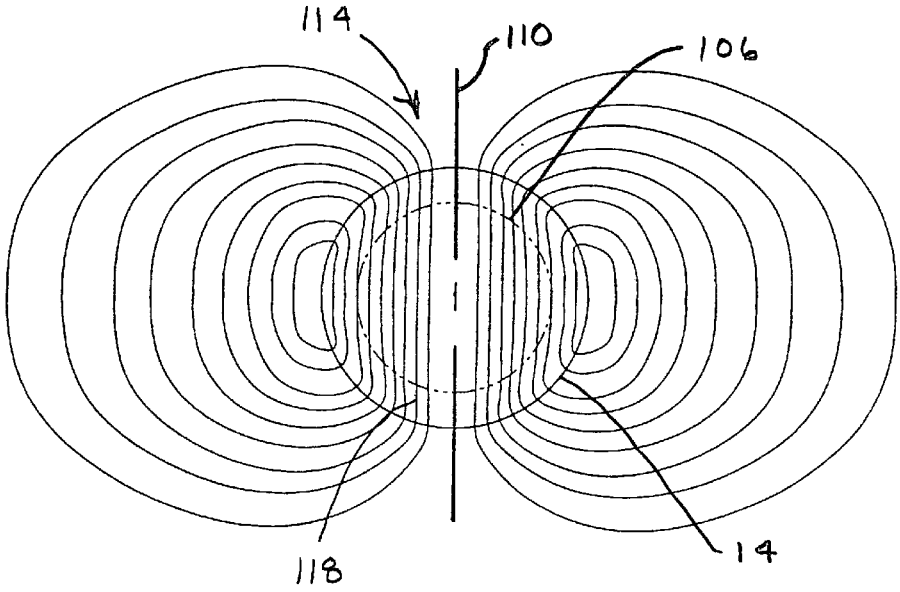
FIG. 7B is a diagram of a more uniformly aligned magnetic field produced with the new winding pattern.

FIGS. 7A and 7B contrast magnetic field effects of a conventionally wound electromagnet 102 with respect to the new electromagnet 14. In FIG. 7A, a conventional straight winding pattern of the electromagnet 102 produces a generally uniaxial magnetic field 104 along a magnetic axis 110 within an area bounded by a substrate periphery 106. However, field lines 108 of the magnetic field 104 are slightly curved in a concave orientation with respect to the magnetic axis 110 of the electromagnet 102. The problematic curvatures of the field lines 108 are particularly pronounced near the substrate periphery 106. In FIG. 7B, the new winding pattern 98 of the electromagnet 14 produces a uniaxial magnetic field 114 along the magnetic axis 110 having straighter field lines 118 throughout a similar area bounded by the substrate periphery 106.

A power supply 120 regulated by a controller 122, both shown in FIG. 1, supplies power to the electromagnetic coil 62 of the electromagnet 14. Although the electromagnet 14 is depicted with only one such electromagnetic coil 62, one or more additional electromagnetic coils can be wrapped in different directions along the plate-shaped core 44 for generating magnetic fields along different magnetic axes. Winding support layers preferably separate the additional coils, and winding guides preferably support similar winding patterns in different orientations across the front side 46 of the core 44. The multiple coils can be powered singularly or in combination to change orientations of the resulting uniaxial magnetic fields. More details of such multi-coil electromagnets are disclosed in co-assigned U.S. application Ser. No. 09/083,363, filed May 22, 1998, entitled "Multiple-coil Electromagnet for Magnetically Orienting Thin Films", which is hereby incorporated by reference.

A circular core periphery 50 is preferred, but improvements in both performance and in space utilization with the chuck housing 40 are also possible from other shapes of the core periphery 50, especially shapes that depart from a rectangle towards a circle. These alternative shapes include regular polygons with increasing numbers of sides.

One particular example of our new electromagnet 12 employs a circular plate-shaped core 44 having a diameter of approximately 26.35 centimeters and a uniform thickness of approximately 6.35 millimeters. HyMu "80" material is used to form the core 44. The windings 74 are made of 20 gauge magnet wire. Approximately 3.0 millimeter shims 66 separate the straight center sections 84 of the front winding portions 80. Operating temperatures of approximately 90° degrees centigrade are expected at a draw of approximately 5 amperes of power. The field strength is approximately 50 Gauss in the plane of the substrate surface 100.

We claim:

1. A thin-film processing electromagnet for producing a uniaxial magnetic field along a surface of a substrate comprising:

a magnetically permeable plate-shaped core having a center, a front side, a back side, a non-rectangular periphery bounding the front and back sides, and first and second orthogonal axes extending parallel to the front side of the plate-shaped core and intersecting at the center of the plate-shaped core;

an electromagnetic coil having a plurality of windings that are wrapped around the first orthogonal axis and extend across the front side of the plate-shaped core; and said windings being arranged in a pattern across the front side of the plate-shaped core such that windings close to the center of the plate-shaped core extend substantially parallel to the second orthogonal axis and windings spaced from the center of the plate-shaped core along the first orthogonal axis are bowed with respect to the second orthogonal axis for reducing skew of the uniaxial magnetic field along the surface of the substrate.

2. The electromagnet of claim 1 in which the windings spaced from the center of the plate-shaped core are bowed in concave shapes facing the center of the core.

3. The electromagnet of claim 2 in which the windings are incrementally more bowed as a function of distance from the center of the plate-shaped core along the first orthogonal axis.

4. The electromagnet of claim 2 in which the windings are laid out in a pattern that is symmetric with respect to both the first orthogonal axis and the second orthogonal axis.

5. The electromagnet of claim 1 in which the windings spaced from the center of the plate-shaped core individually include a center section that is substantially parallel to the second orthogonal axis across the front side of the plate-shaped core and two end sections that are bent with respect to the second orthogonal axis across the front side of the plate-shaped core.

6. The electromagnet of claim 5 in which the center sections of the windings incrementally decrease in length as a function of distance from the center of the plate-shaped core along the first orthogonal axis.

7. The electromagnet of claim 5 in which a spacing between the center sections of the windings along the first orthogonal axis is greater than a spacing between the end sections of the windings at the core periphery.

8. The electromagnet of claim 7 in which angles formed between the second orthogonal axis and the bent sections of the windings along the core periphery incrementally increase as a function of distance from the core center along the first orthogonal axis.

9. The electromagnet of claim 1 in which the first and second orthogonal axes define a reference plane and the non-rectangular periphery departs from a rectangular shape to more completely fill a circular area of the reference plane.

10. The electromagnet of claim 9 in which the non-rectangular periphery has a substantially circular shape in the reference plane.

11. The electromagnet of claim 1 further comprising a winding guide mounted on the front side of the plate-shaped core including spacing features for bowing windings with respect to the second orthogonal axis.

12. The electromagnet of claim 11 in which the spacing features include shims for spacing the windings apart from each other along the first orthogonal axis.

13. A chuck assembly for supporting a substrate in a substrate processing environment and for magnetically orienting a magnetic film on a surface of the substrate comprising:

a chuck housing having a mounting surface for supporting the substrate within the processing environment;

an electromagnet located within an interior space of the chuck housing for producing a substantially uniaxial magnetic field in a plane of the substrate's surface;

a magnetically permeable core of the electromagnet having a center, a periphery, and front and back sides wrapped by electrically conductive windings;

the core periphery departing from a rectangular shape to more completely fill the interior space of the chuck housing;

front portions of the electrically conductive windings extending across the front side of the magnetically permeable core between the front side of the magnetically permeable core and the mounting surface of the chuck housing;

back portions of the electrically conductive windings extending across the back side of the magnetically permeable core in positions separated from the mounting surface by the magnetically permeable core; and the front winding portions individually departing from a linear form by differing amounts to reduce skew of the uniaxial magnetic field throughout the plane of the substrate's surface.

14. The chuck assembly of claim 13 in which the front winding portions include respective lengths divided in different proportions between a straight section and two bent sections.

15. The chuck assembly of claim 14 in which the straight sections of the front winding portions extend normal to a winding axis, and the straight sections incrementally decrease in length from the center towards the periphery of the core along the winding axis.

16. The chuck assembly of claim 14 in which a spacing between adjacent straight sections of the front winding portions is greater than a spacing between adjacent bent sections of the front winding portions along the core periphery.

17. The chuck assembly of claim 16 in which an amount of bending of the bent sections at the core periphery increases as a function of a cumulative difference in spacing between the straight and bent sections.

18. The chuck assembly of claim 14 in which the bent sections are bent with respect to the straight sections toward the core center.

19. The chuck assembly of claim 13 in which the electrically conductive windings are wound around a winding axis that intersects the core center, and the individual front winding portions depart from the linear form by increasing amounts from the core center along the winding axis.

20. The chuck assembly of claim 13 in which the magnetically permeable core is plate-shaped.

21. The chuck assembly of claim 20 in which the interior space of the chuck housing is substantially circular and the core periphery departs from a rectangular shape to more completely fill the circular space within the chuck housing.

22. The chuck assembly of claim 21 in which the core periphery has a substantially circular shape.

23. The chuck assembly of claim 13 further comprising a winding guide mounted on the front side of the core including spacing features for bowing windings to depart from the linear form.

24. The chuck assembly of claim 23 in which the spacing features include shims for spacing the front winding portions apart from each other.

25. A method of assembling a plate-shaped electromagnet for reducing skew of a uniaxial magnetic field effective for magnetically orienting a thin magnetic film on a surface of a substrate comprising the steps of:

forming a winding guide on a front side of a plate-shaped core having a center, a front side, a back side, a non-rectangular periphery bounding the front and back sides, and first and second orthogonal axes extending parallel to the front side of the plate-shaped core and intersecting at the center of the plate-shaped core;

wrapping a plurality of windings of an electromagnetic coil around the first orthogonal axis; and extending the plurality of windings across the front side of the plate-shaped core along the winding guide such that windings close to the center of the plate-shaped core extend substantially parallel to the second orthogonal axis and windings spaced from the center of the plate-shaped core along the first orthogonal axis are bowed with respect to the second orthogonal axis for reducing skew of the uniaxial magnetic field along the surface of the substrate.

26. The method of claim 25 including a further step of dividing individual windings extending across the front side of the core into straight center sections and two bent end sections.

27. The method of claim 26 including a further step of incrementally decreasing a length of the straight center sections as a function of distance from the center of the plate-shaped core along the first orthogonal axis.

28. The method of claim 26 including a further step of spacing the center sections of adjacent windings apart by an amount greater than a spacing separating the end sections of the windings at the core periphery.

29. The method of claim 28 including a further step of incrementally increasing angles between the second orthogonal axis and the bent sections of the windings along the core periphery as a function of distance from the core center along the first orthogonal axis.

* * * * *